US008148621B2

(12) United States Patent
Bright et al.

(10) Patent No.: US 8,148,621 B2
(45) Date of Patent: Apr. 3, 2012

(54) SCORING OF FREE-FORM VOCALS FOR VIDEO GAME

(76) Inventors: Brian Bright, Woodland Hills, CA (US); Brian Marvin, Woodland Hills, CA (US); Mark Wojtowicz, Woodland Hills, CA (US)

( * ) Notice: Subject to any disclaimer, the term of this patent is extended or adjusted under 35 U.S.C. 154(b) by 100 days.

(21) Appl. No.: 12/366,522

(22) Filed: Feb. 5, 2009

(65) Prior Publication Data

US 2010/0192752 A1 Aug. 5, 2010

(51) Int. Cl.
*G10H 1/00* (2006.01)

(52) U.S. Cl. ..... 84/609; 84/649; 84/601; 434/307 A

(58) Field of Classification Search ..... 84/600–602, 84/609, 649; 434/307 A
See application file for complete search history.

(56) References Cited

U.S. PATENT DOCUMENTS 5,250,745 A * 10/1993 Tsumura ..... 434/307 A
5,395,123 A * 3/1995 Kondo ..... 273/454
5,434,949 A * 7/1995 Jeong ..... 704/270
5,511,053 A * 4/1996 Jae-Chang ..... 369/53.34
5,525,062 A * 6/1996 Ogawa et al. ..... 434/307 A
5,557,056 A * 9/1996 Hong et al. ..... 84/610
5,563,358 A * 10/1996 Zimmerman ..... 84/477 R
5,565,639 A * 10/1996 Bae ..... 84/477 R
5,567,162 A * 10/1996 Park ..... 434/307 A
5,693,903 A * 12/1997 Heidorn et al. ..... 84/668
5,715,179 A * 2/1998 Park ..... 702/182
5,719,344 A * 2/1998 Pawate ..... 84/609
5,804,752 A * 9/1998 Sone et al. ..... 84/610
5,817,965 A * 10/1998 Matsumoto ..... 84/610
5,831,190 A * 11/1998 Trabucco, Jr. ..... 84/477 R
5,847,303 A * 12/1998 Matsumoto ..... 84/610
5,889,224 A * 3/1999 Tanaka ..... 84/645
6,182,044 B1 * 1/2001 Fong et al. ..... 704/270
6,252,153 B1 * 6/2001 Toyama ..... 84/634
6,326,536 B1 * 12/2001 Wang ..... 84/477 R
6,495,747 B2 * 12/2002 Shimaya et al. ..... 84/477 R
6,703,551 B2 * 3/2004 Ueshima et al. ..... 84/616
6,967,275 B2 * 11/2005 Ozick ..... 84/616
7,164,076 B2 * 1/2007 McHale et al. ..... 84/616
7,271,329 B2 * 9/2007 Franzblau ..... 84/609
7,304,229 B2 * 12/2007 Chang ..... 84/610
7,323,631 B2 * 1/2008 Miyaki et al. ..... 84/616
7,674,181 B2 * 3/2010 Yates ..... 463/35
2001/0029830 A1 * 10/2001 Rosen ..... 84/478
2004/0123726 A1 * 7/2004 Kato et al. ..... 84/609
2005/0031212 A1 * 2/2005 Suino ..... 382/232
2005/0115383 A1 * 6/2005 Chang ..... 84/616
2005/0252362 A1 * 11/2005 McHale et al. ..... 84/616
2005/0255914 A1 * 11/2005 McHale et al. ..... 463/31
2005/0262989 A1 * 12/2005 Franzblau ..... 84/47 R
2006/0009979 A1 * 1/2006 McHale et al. ..... 704/270
2006/0011046 A1 * 1/2006 Miyaki et al. ..... 84/616
2006/0246407 A1 * 11/2006 Kang et al. ..... 434/307 A
2006/0272488 A1 * 12/2006 Fujishima et al. ..... 84/712
2007/0059670 A1 * 3/2007 Yates ..... 434/107

(Continued)

*Primary Examiner* — David S. Warren
(74) *Attorney, Agent, or Firm* — Klein, O'Neill & Singh, LLP

(57) ABSTRACT

A music based video game in which a game player's singing performance is digitally sampled while the player performs a free-form vocal over a prerecorded musical composition. Aspects of the game player's free-form vocal performance are compared with predetermined criteria. For example, the vocal performance may be compared with tempo and key information to generate performance evaluation data. The performance evaluation data may be used to present performance feedback to the game player while the game player is singing.

18 Claims, 9 Drawing Sheets

U.S. PATENT DOCUMENTS

2007/0155477 A1* 7/2007 Gevisser ..... 463/20
2008/0070203 A1* 3/2008 Franzblau ..... 434/157
2009/0165633 A1* 7/2009 Kyuma et al. ..... 84/610
2009/0210220 A1* 8/2009 Mitsuyoshi et al. ..... 704/207
2009/0314154 A1* 12/2009 Esaki et al. ..... 84/611
2009/0317783 A1* 12/2009 Noguchi ..... 434/307 A
2010/0192752 A1* 8/2010 Bright et al. ..... 84/610
2010/0192753 A1* 8/2010 Gao et al. ..... 84/610
2010/0233661 A1* 9/2010 Franzblau ..... 434/178

* cited by examiner

SCORING OF FREE-FORM VOCALS FOR VIDEO GAME

BACKGROUND OF THE INVENTION

The present invention relates generally to video games, and more particularly to a music based video game including vocals.

Video games provide a source of entertainment for many. Video games provide game players with different interactive challenges, many of which simulate interesting situations and scenarios that game players may not typically experience. Music video games, for example, often provide game players with the opportunity to participate in a live musical performance, and to be scored or graded on their performance.

In some music video games, a game player is presented lyrics to sing, along with possibly an indication of a pitch at which to sing the lyrics, with the pitch potentially being different for different portions of the lyrics. Along with the lyrics, the game player may also be presented with instrumental audio to accompany the lyrics. The game player's singing of the lyrics is generally received by a microphone and converted to electrical signals for processing by a game console.

However, merely singing predetermined lyrics of a song may not fully simulate a musical experience, for example, the creativity and originality which may be part of the musical experience.

BRIEF SUMMARY OF THE INVENTION

The invention provides a music based video game in which a game player's or game players' free-form singing or other voice based performance is evaluated. In one aspect the invention provides a method for evaluating vocal inputs of a game player in a music based video game, comprising: receiving input signals providing audio information; determining, for a particular time, a pitch of the audio information; comparing the pitch to a plurality of target pitches, at least some of the pitches of the plurality of target pitches separated from other pitches of the plurality of target pitches by pitches not of the plurality of target pitches; determining a valuation based on the comparison of the pitch to the plurality of target pitches; and commanding presentation of an indication of the valuation.

In another aspect the invention provides a method for evaluating vocal inputs in a music based video game, comprising: repeatedly over time receiving input signals providing audio information; repeatedly over time determining a pitch of the audio information; determining if changes in pitch are in accordance with a target tempo; determining a valuation based on whether the changes in pitch are in accordance with the target tempo; and commanding presentation of an indication of the valuation.

In another aspect the invention provides a system for scoring vocal inputs in a music based video game, comprising: an input device to provide an input signal including audio information; and a processor configured by program instructions to: determine pitch of the audio information; determine how accurately the pitch conforms with a key associated with a musical piece; determine how accurately changes in the pitch over time match a tempo of the musical piece; and determine a change in point score based on the degree of the accuracies.

In another aspect the invention provides a method for providing a video game, comprising: commanding display of a commanded pitch and lyrics; commanding audio presentation of at least a portion of a musical piece; receiving an input signal including audio information; determining a pitch of the audio information; determining if the pitch matches the commanded pitch; increasing a point score if the pitch matches the commanded pitch; commanding display of an indication that a game player should perform free-form vocals; receiving over time further input signals including further audio information; determining over time pitch of the further audio information; comparing the pitch of the further audio information to notes associated with a key of the musical piece; comparing changes in pitch over time of the further audio information to a tempo of the musical piece; further increasing the point total if the pitch of the further audio information matches the notes associated with the key of the musical piece; further increasing the point total if the changes in pitch over time of the further audio information matches the tempo of the musical piece.

These and other aspects of the invention are more fully comprehended upon review of the disclosure.

DETAILED DESCRIPTION

Figure 1:
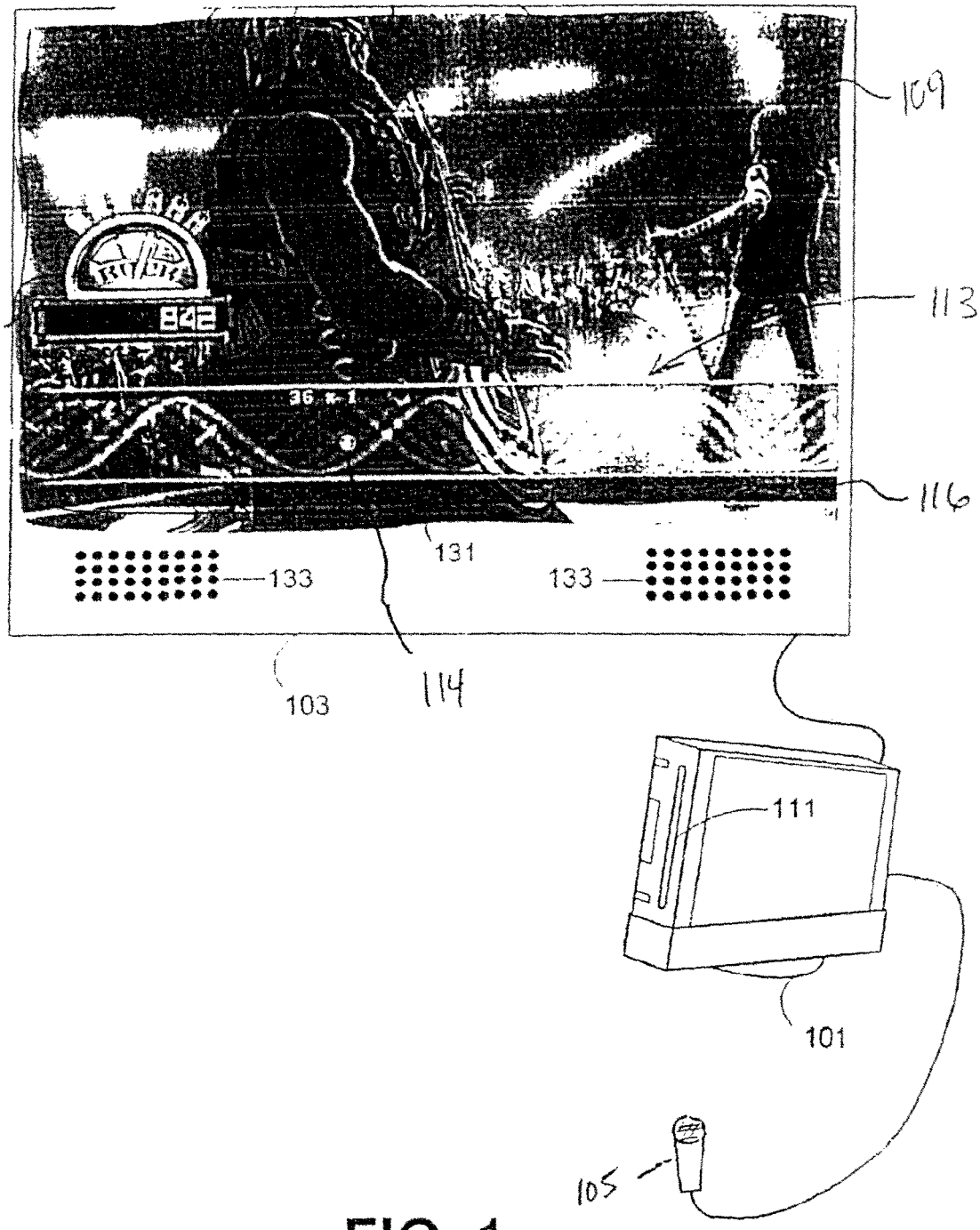
FIG. 1 is an example of a video game system in accordance with aspects of the invention.

FIG. 1 is an example of a video game system in accordance with aspects of the invention. The video game system includes a video game console 101, a display 103, and a microphone 105. The video game console includes internal circuitry which allows the console to run a video game by executing various program instructions related to proper execution of the video game. The video game console typically includes one or more processors, memory, and various interface circuitry for running a video game. The instructions for each specific video game are generally found on a removable memory source such as a video game CD-ROM, inserted into a removable memory interface 111 of the video game console. In some embodiments of the invention, the video game console may alternatively be a handheld gaming device, including similar internal circuitry as herein described, as well as, for example, a built in display or displays and various different game player input devices, or in some embodiments a computer, for example a personal computer, may be used.

The video game console is coupled to the microphone by a wired connection, although it should be recognized that in many embodiments the microphone and video game console include wireless communication capability, and information from the microphone or between the microphone and video game console may be transferred by way of wireless communications. In addition, in various embodiments input devices other than microphones may instead or additionally be used, for example guitar shaped controllers, drum controllers, joystick controllers or other similar game controllers.

The video game console is also in communication with a display unit 103, generally through an audio-video cable or similar wired connection, although a wireless connection may be used in some embodiments. The display unit is typically a television, although in some embodiments a monitor may be used, with a display screen 131 and at least one audio output device, such as a speaker 133. In the embodiment of FIG. 1, the display screen shows a screen shot 109 of video game play in a music related video game.

As illustrated in FIG. 1, the screen shot of video game play generally displays an image of a singer 109 singing, and a waveform 113. A marker 114 is present within an area displaying the waveform. The marker indicates a pitch of inputs to the microphone. The waveform serves as an indicator that a game player is to sing in an improvisational or free-form manner along with a musical piece, or a portion of a musical piece. In various embodiments, however, different images or indicators may instead or in addition be provided to indicate that the game player is to sing in an improvisational or free-form manner. In most embodiments music is also provided to the game player by way of the speaker, and the game player is to sing or otherwise provide inputs to the microphone in a manner which meets general or specific criteria relating to the music. The general criteria may be based on criteria expected to provide an aesthetically pleasing vocal performance when performed in conjunction with the music.

For example, the music may generally be in a certain key, with the game player to sing or otherwise provide inputs to the music in or consistent with the certain key or in a pattern relating to the certain key. In many instances a vocal performance is aesthetically pleasing if, for example, singing at any particular time is performed at any of a plurality of different pitches, with at least some of the different pitches separated by other pitches. For example, in some instances a vocal performance may be aesthetically pleasing if either a pitch represented by a center A or a pitch represented by a center C is sung or bother at separate times, but not if a center B is sung, with a center B, between a center A and center C. In some embodiments the game player is to sing in any of a plurality of predetermined, or target, pitches. The target pitches may be pitches in accordance with the certain key.

Also for example, the music may be to a certain beat, have certain percussive accents, have a certain tempo, or otherwise have a certain rhythmic component, with the game player to sing or otherwise provide inputs to the music in accordance with the certain beat, certain percussive accents, certain tempo, or certain rhythmic component. In many instances a vocal performance is aesthetically pleasing if singing, for example, includes pitch changes at the same time as beats in the music or with the same tempo of the music. In some embodiments, visual indicators may be provided to the game player by way of the display, with relative timing of an indication of beats or accents displayed, for example, along with a current time indicator displayed with respect to beat or accent timing. For example, a comet, indicating a current time, could pass over a series of lines which indicate tempo of the song, or lines could be displayed in a scrolling manner with respect to a predefined portion of the display.

During game play the game player may sing or otherwise provide inputs to the microphone, with the video game console determining a score or otherwise providing feedback based on the game player's performance in singing or otherwise providing inputs to the microphone consistent with or in the certain key, with the certain beat, or otherwise in conformance with general criteria that relate to the music or a portion of the music. The video game console may command the display to display the score and/or otherwise provide audio or video feedback to the game player as to the game player's performance, as well as display images of a singer singing along with other images of a musical performance.

In some embodiments, during parts of the game the video game console commands presentation of an instructive cue or cues that a particular pitch is to be sung at a particular time, generally with the instructive cues indicating changes in the particular pitch at various times. The video game console may also command presentation of lyrics to be sung, and possibly also pitch durations, slopes indicating pitch increases and decreases. The video game console scores the game player based on, for example, compliance with the instructive cue. During other parts of the game the video game console commands presentation of an indication to the game player that the game player is to sing in a manner consistent with a musical piece, instead of just a particular pitch at a particular time, and scores the game player based on the game player singing in a manner consistent with the musical piece.

Figure 2:
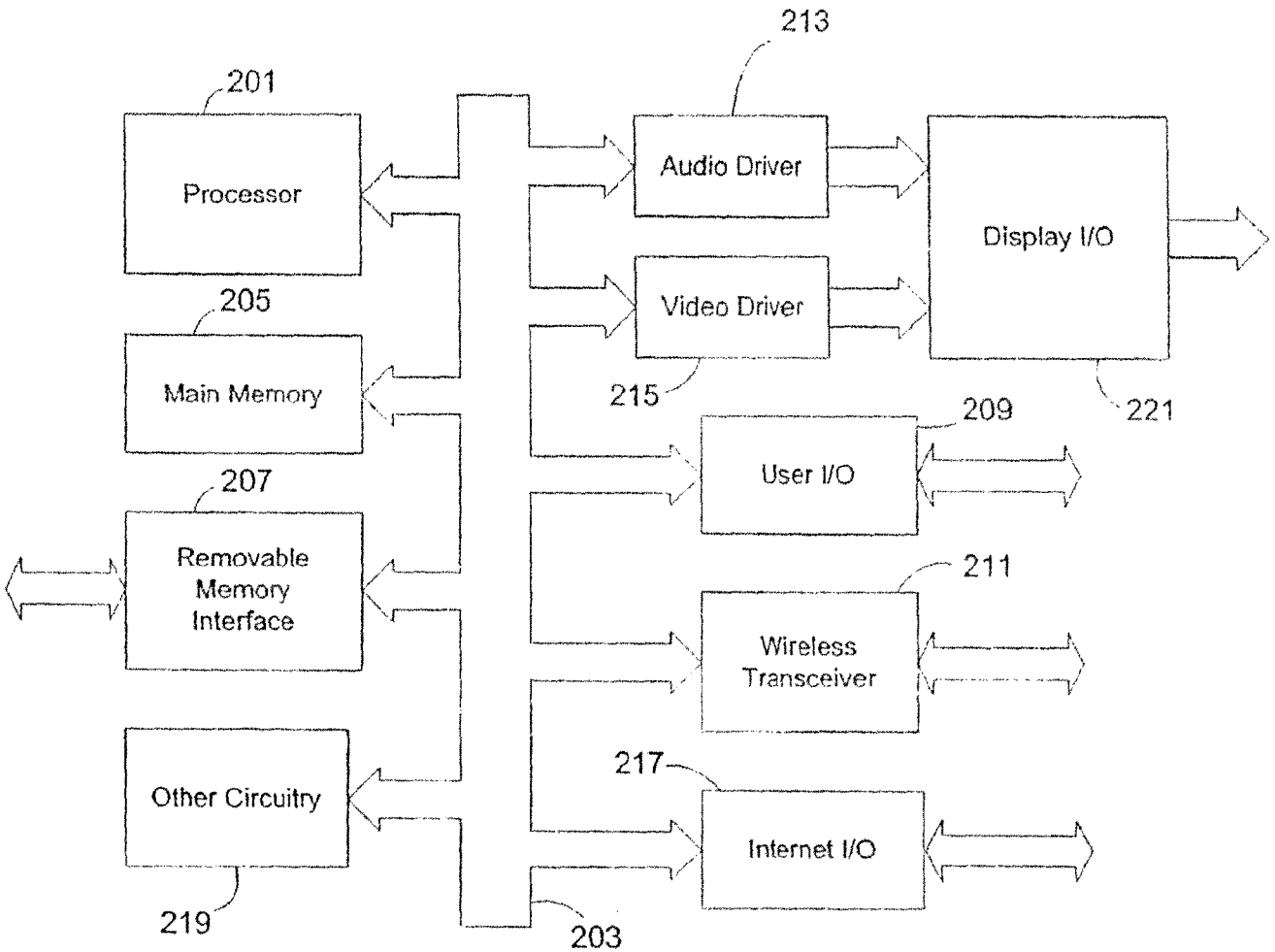
FIG. 2 is an example of a block diagram of a video game console processing unit in accordance with aspects of the invention.

FIG. 2 is an example of a block diagram of a video game console in accordance with aspects of the invention. In the embodiment of FIG. 2, the video game console includes at least one processor 201 interconnected with other components via a system bus 203. The other components may include, for example, a main memory 205 of the video game console, a removable memory interface 207, a user input/output port 209, a wireless transceiver 211, an audio driver 213, a video driver 215, an Internet input/output port 217, and other circuitry 219, which may include for example an infrared sensor. In other embodiments of the invention, there may be different combinations of components that make up a video game console, depending on the individual needs of each application.

The processor executes software instructions, including video game instructions, to facilitate video game play of, for example, the music based video game described with respect to FIG. 1. The processor may use the components of the processing unit in order to execute the software instructions. The processor may retrieve video game instructions for a specific video game from a removable memory source, for example, a video game CD-ROM, inserted into the removable memory interface of the video game console. The processor may process the video game instructions in accordance with console specific program instructions, which are generally found in the main memory of the video game console. The processor also receives game player input signals from a connected video game controller or microphone, either through the user input/output port or the wireless transceiver. The processor processes the various instructions and received input signals to generate audio and video output signals representative of video game play.

The processor may also be in data communication with a display unit, which outputs audio and video outputs of video game action to a game player of the system. The processor may send audio generation information to the audio driver, and video generation information to the video driver, each of which generates audio and video output signals, respectively, from the received generation information. The audio and video drivers forward the audio and video output signals through a combined display input/output port 221, or alternatively, separate audio and video input/output ports, to the display unit.

In some embodiments, the processor is also connected to the Internet via either the Internet input/output port, or via the wireless transceiver. A connection to the Internet may be used to facilitate multiplayer game play with other game players in remote locations if a multiplayer option is provided by a particular video game. In some embodiments, an Internet connection may also be used by video game publishers to offer, for free or for sale, various downloadable content associated with a particular game. In the music based video game of FIG. 1, downloadable content may include, for example, new songs or background audio tracks.

Figure 3:
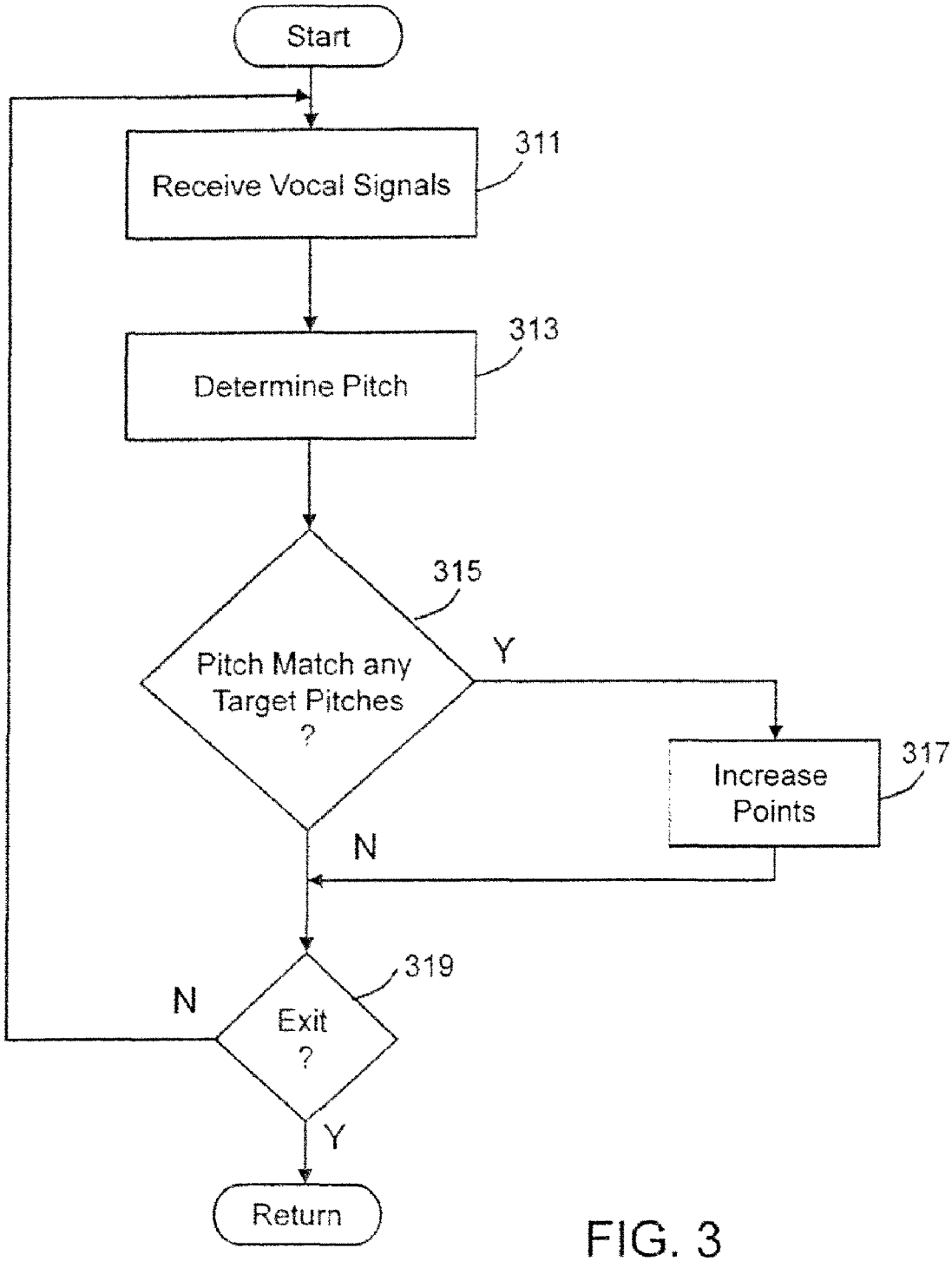
FIG. 3 is a flow diagram of a process of a video game for providing game player feedback for a vocal performance.

FIG. 3 is a flow diagram of a process of a video game for evaluating a game player who is to sing in a manner generally consistent with a song. The process may be performed by a processor or a video game console, which may receive input signals from a microphone.

In block 311 the process receives input signals. Generally the input signals include information of or representative of sounds, for example a player singing. The input signals, for example, may be provided by a microphone, which converts sound to electrical signals.

In block 313 the process determines pitch of the input signals. Pitch of the input signals may be determined, for example, by performing a Fast Fourier Transform (FFT) on digital samples of the vocal signals and determining frequencies with maximums of amplitude, or by a wide variety of other methods. In one embodiment pitch of the input signals is determined as described in McLeod, P. and Wyvill, G. "A Smarter Way to Find Pitch", Proceedings of International Computer Music Conference (ICMC) 2005, Barcelona, Spain, (2005) 138-141, which is incorporated herein by reference for all purposes.

In block 315 the process determines if pitch of the input signals matches any of a plurality of target pitches. In most embodiments the target pitches are separated in frequency from one another. In some embodiments the target pitches are ranges of target pitches, with each of the ranges of target pitches separated in frequency from one another. The target pitches are generally predetermined, for example by a game developer, and may be based on a key of a song, for example a song whose audio, or portions of audio, are presented to the game player.

Figure 4:
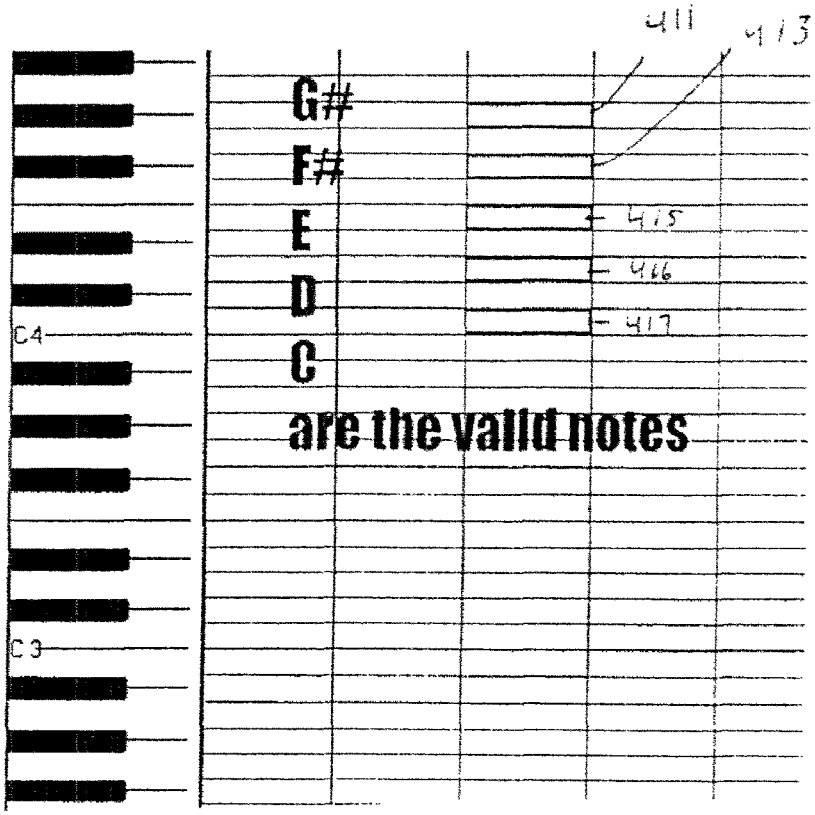
FIG. 4 is a diagram illustrating example target pitches for vocals in a video game.

FIG. 4 provides a visual example of a plurality of target pitches. FIG. 4 provides a representation of a portion of a piano keyboard, with a plurality of target pitches 411, 413, 415, 416, and 417 indicated relative to the portion of the piano keyboard. In the example of FIG. 4, the plurality of target pitches include pitches indicated by G#, F#, E, D, and middle C.

Returning to FIG. 3, if pitch of the input signals matches any of the plurality of target pitches the process proceeds to block 317 and determines a valuation. In the example process of FIG. 3, the valuation is reflected in the form of an increase in points. In various embodiments the valuation may instead be reflected in the sound of a cheering crowd provided by the video game, or by a display element provided by the video game. In most embodiments an indication of the valuation, for example a point score, is commanded to be presented by way of a display or audio speakers.

If pitch of the input signals does not match any of the plurality of target pitches, or after performing operations of block 317, the process continues to block 315. In block 315 the process determines if the process should exit. If so, the process returns, otherwise the process goes to block 311.

Figure 5:
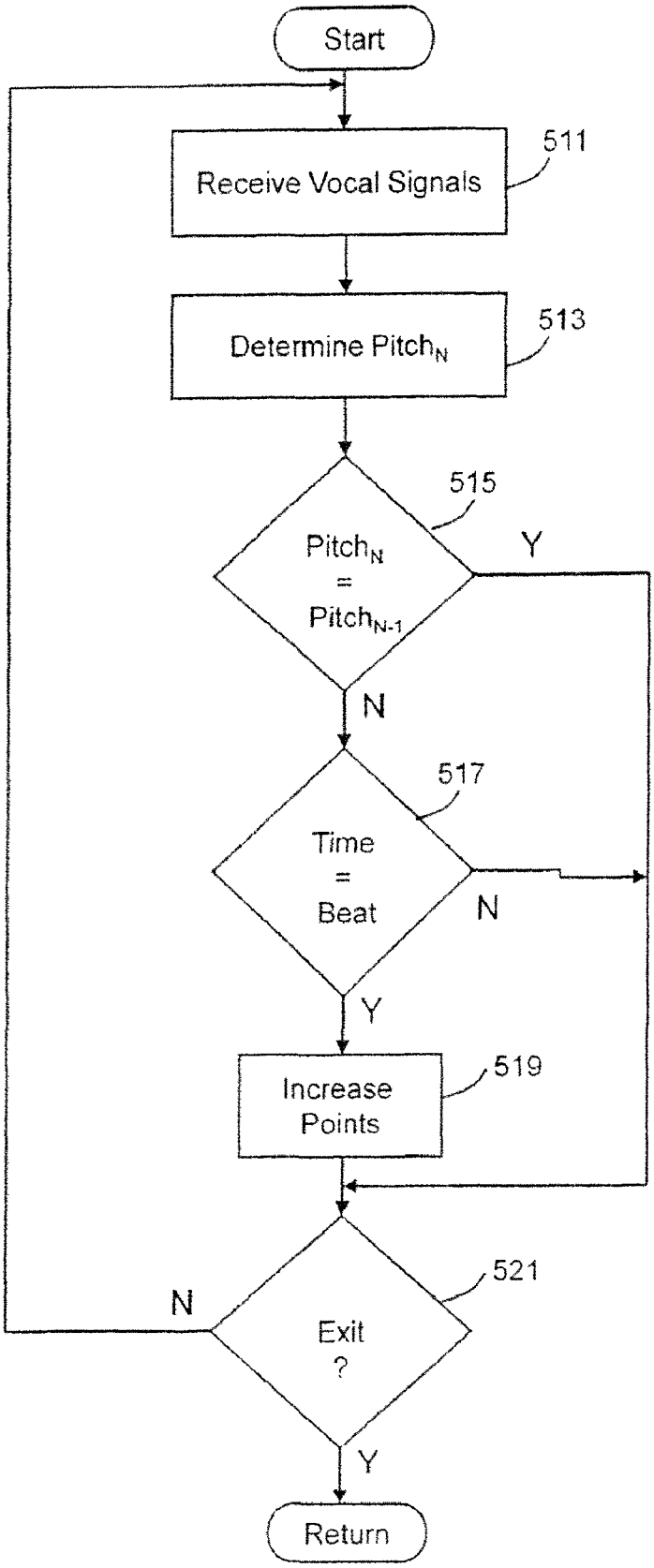
FIG. 5 is a flow diagram of a further process of a video game for providing game player feedback for a vocal performance.

FIG. 5 is a flow diagram of a further process of a video game for evaluating a game player who is to sing in a manner generally consistent with a song. The process may be performed by a processor or a video game console, which may receive input signals from a microphone.

In block 511 the process receives input signals. Generally the input signals include information of or representative of sounds, for example a player singing. The input signals, for example, may be provided by a microphone, which converts sound to electrical signals.

In block 513 the process determines pitch of the input signals. Pitch of the input signals may be determined, for example, by performing a Fast Fourier Transform (FFT) on digital samples of the vocal signals and determining frequencies with maximums of amplitude, or by a wide variety of other methods. In one embodiment pitch of the input signals is determined as described in the aforementioned McLeod, P. and Wyvill, G. "A Smarter Way to Find Pitch", Proceedings of International Computer Music Conference (ICMC) 2005, Barcelona, Spain, (2005) 138-141.

In block 515 the process determines if the pitch of the input signals matches pitch of prior input signals, namely if the input signals indicate a change in pitch. For example, the process may, considering the repeating nature of the process as indicated below, determine pitch at periodic times. Thus, the process may for example, compare pitch of input signals for a time N with pitch of input signals from a time N-1, where N indicates a time index.

If the pitch of the input signals matches the pitch of prior input signals the process proceeds to block 521, otherwise the process continues to block 517. In block 517 the process determines if the time of the change in pitch equals a time of a beat. The time of the beat may be the time of a beat in a song, which may be presented to a game player, for example by way of speakers. In some embodiments, the process additionally considers the time of the change in pitch to equal a time of the beat if the time of the change in pitch is midway between two beats, or in some embodiments if the time of the change in pitch is a quarter way between two beats. In addition, in some embodiments the process may determine time of the change in pitch to equal a time of the beat if the time of the change in pitch is slightly after the time of the beat. This may be beneficial, for example, to account for delays of signal generation or propagation due to a microphone, and/or to account for processing delays.

The time of the beat may also be commanded to be visually indicated to a game player on a display. For example, for the display of FIG. 1 scrolling vertical lines may scroll through a fixed position of the marker 114, with coincidence of a vertical line and the marker indicating a beat time. Alternatively, the vertical lines may be fixed, with the marker scrolling across the display, again with coincidence of the marker and a vertical line indicating a beat time. In addition, in some embodiments the process of FIG. 5 may be performed in the context of a multiplayer music video game, for example including a scrolling note track for providing instructive cues to other players, who may be using game controllers in the shape of a guitar. In such embodiments, beat time may instead or in addition be indicated by display elements within or associated with the note track.

Returning to FIG. 5, if the time of the pitch change does not equal the time of the beat, the process proceeds to block 521. Otherwise, in block 519 the process determines a valuation. The valuation may be, for example, an adjustment to a point score, for example, an increase in a point score as indicated in FIG. 5. In most embodiments the process also provides a game player an indication of the valuation, for example by way of commanding display of a point score, or by some other presentation. For example, as indicated in FIG. 6, a point score 643 for the game player may be displayed, along with a point score 637 for another game player, with the other game player for example using a game controller in the general shape of a musical instrument, for example a guitar shaped game controller.

In block 521 the process determines whether the process is to exit. If so, the process returns, otherwise the process repeats by going to block 511.

Figure 6:
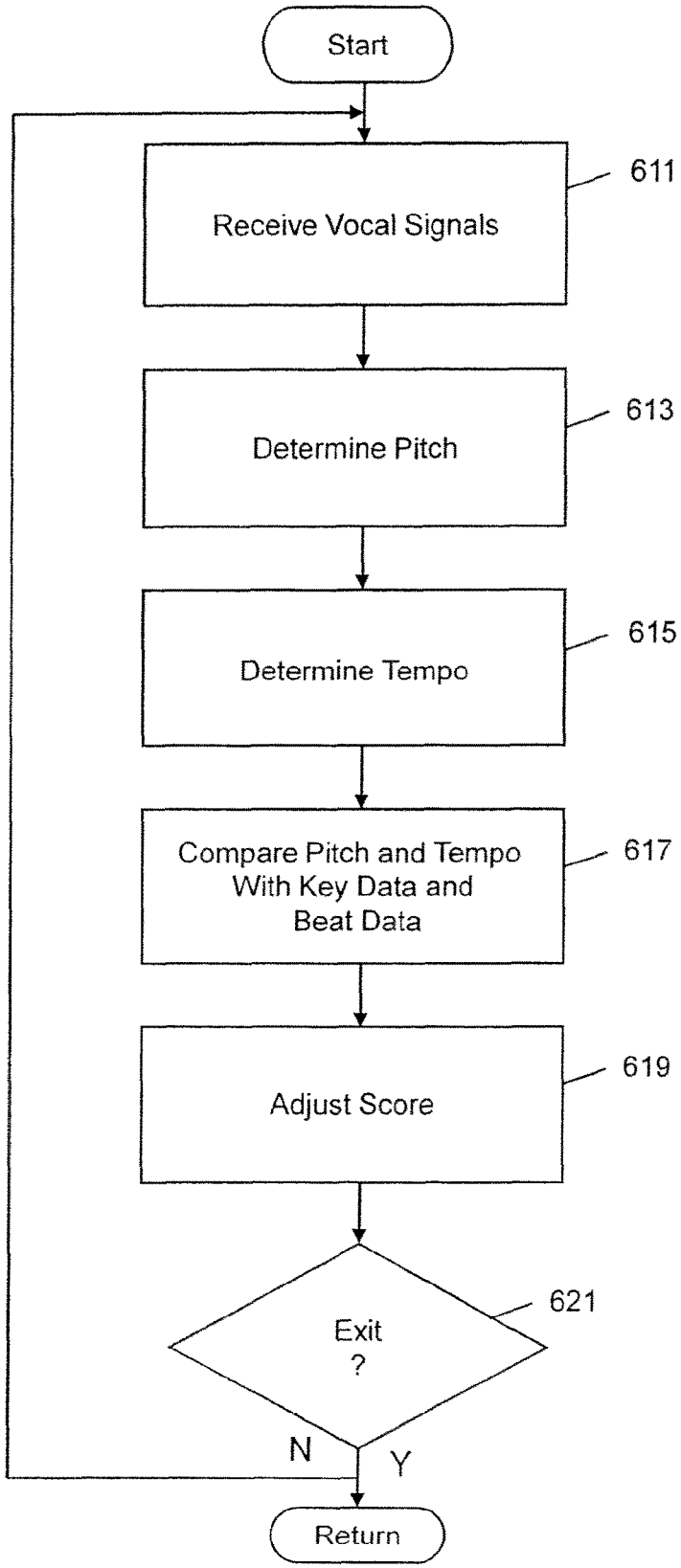
FIG. 6 is a flow diagram of a process of a video game for providing a score for a game player vocal performance accompanying song instrumentals of a video game.

FIG. 6 is a flow diagram of a process for evaluating, for example by determining a score, a game player who is to sing in a manner generally consistent with a musical piece. The process may be performed by a processor or a video game console, which may receive input signals from a microphone.

In block 611 the process receives input signals. Generally the input signals include information of or representative of sounds, for example a game player singing. The input signals, for example, may be provided by a microphone, which converts sound to electrical signals.

In block 613 the process determines pitch of the input signals. Pitch of the input signals may be determined, for example, by performing a Fast Fourier Transform (FFT) on digital samples of the vocal signals and determining frequencies with maximums of amplitude, or by a wide variety of other methods. In one embodiment pitch of the input signals is determined as described in the aforementioned McLeod, P. and Wyvill, G. "A Smarter Way to Find Pitch", Proceedings of International Computer Music Conference (ICMC) 2005, Barcelona, Spain, (2005) 138-141.

In block 615 the process determines a tempo of the input signals. In some embodiments the process determines tempo of the input signals by determining times at which the input signals change pitch. In some embodiments the process determines tempo of the input signals by determining when the input signals are at a minimum, for example possibly indicating a brief period of silence.

In block 617 the process compares the pitch of the input signals and the tempo of the input signals with data regarding a target key and a target tempo. The target key may be a pre-identified key and the target tempo may be a pre-identified tempo.

In some embodiments the comparison of the pitch of the input signals with data regarding the target key compares the pitch of the input signals with a plurality of pitches. In some embodiments the plurality of pitches may be a pitch of a particular note and pitches of notes separated tonally from the particular note by one or more octaves. In some embodiments the plurality of pitches may be a pitch of a particular note and pitches of notes in a scale of notes including the particular note. In some embodiments the plurality of pitches may be predetermined separate target pitches, for example target pitches selected by a game developer.

In some embodiments the comparison of the tempo of the input signals with data regarding the target tempo compares timing of changes in pitch of the input signals with timing of beats of a song. In some embodiments the comparison of timing of changes in pitch of the input signals is with respect to a delayed version of timing of beats of a song, for example, to account for processing delays of the input signals and/or delays in converting sound to electrical signals by a microphone used as an input device for sound. In some embodiments the comparison of the tempo of the input signals with data regarding the target tempo compares a history of timing of changes in pitch of the input signals with a pre-identified tempo, which may be a tempo for a song.

In most embodiments the target key and the target tempo are the key and the tempo of a musical piece to which the player is to sing. For example, in a video game, a player may be attempting to generally sing with a pitch and a tempo consistent with a particular musical piece. In other embodiments, however, the target key may be that of a portion of a song or a component of a song, for example a key of a lead guitar for a portion of the song, for example during a solo or simply target notes from that solo. In still other embodiments, the target key and/or the target tempo may simply be any key and/or tempo selected by a developer of the game.

In block 619 the process adjusts a score, for example a point value, for the game player. The score is increased, in some embodiments, if the input signals reflect that the game player has sung over a period of time in the target key or within a preidentified number of semitones of the target key. Similarly, the score may be increased if the input signals reflect that the game player has sung with a tempo matching, or matching within a preidentified time period, of the target tempo. In most embodiments the process displays the score to the game player, for example by way of a display such as the display of FIG. 1, and in many embodiments the process saves the score in memory, for example the memory of FIG. 2.

In some embodiments, however, in block 619, or blocks of other processes that may provide for adjustment of score, the process determines a valuation other than a score, and for example provides feedback to the game player regarding the game player's performance in a manner other than or in addition to adjusting a score. For example, in some embodiments a volume of crowd cheering may be increased in situations where the score would be increased, or a volume or display may be modified in situations where the score would be increased.

In block 621 the process determines whether to exit. If the process is not to exit the process goes to block 611, otherwise the process returns.

Figure 7:
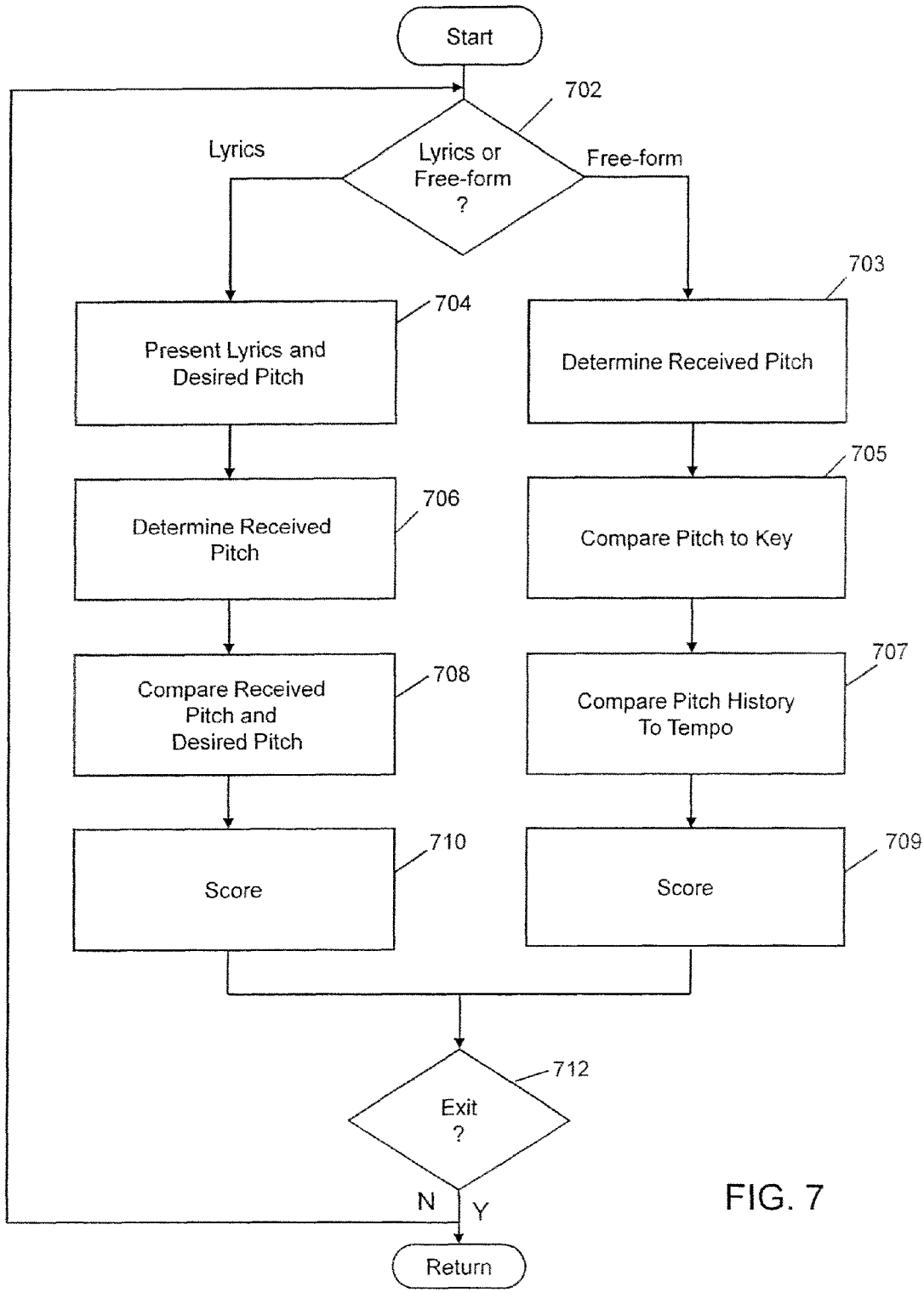
FIG. 7 is a flow diagram of a video game process in accordance with aspects of the invention.

FIG. 7 is a flow diagram illustrating a music video game process of a music video game in accordance with embodiments of the present invention. The process may be performed, for example, by a processor or a video game console, which may receive input signals from a microphone.

In block 702, the process determines whether the video game is in a lyrics mode or a free-form vocals mode. In some embodiments preselected portions of the video game are lyrics mode portions and other preselected portions of the video game are free-form vocals portions of the video game. In some embodiments, the video game is in lyrics mode unless a predetermined point score is reached or some other measure of game player performance is reached. If the video game is in the lyrics mode the process continues to block 704; if it is in the free-form vocals mode the process continues to block 703.

Figure 8:
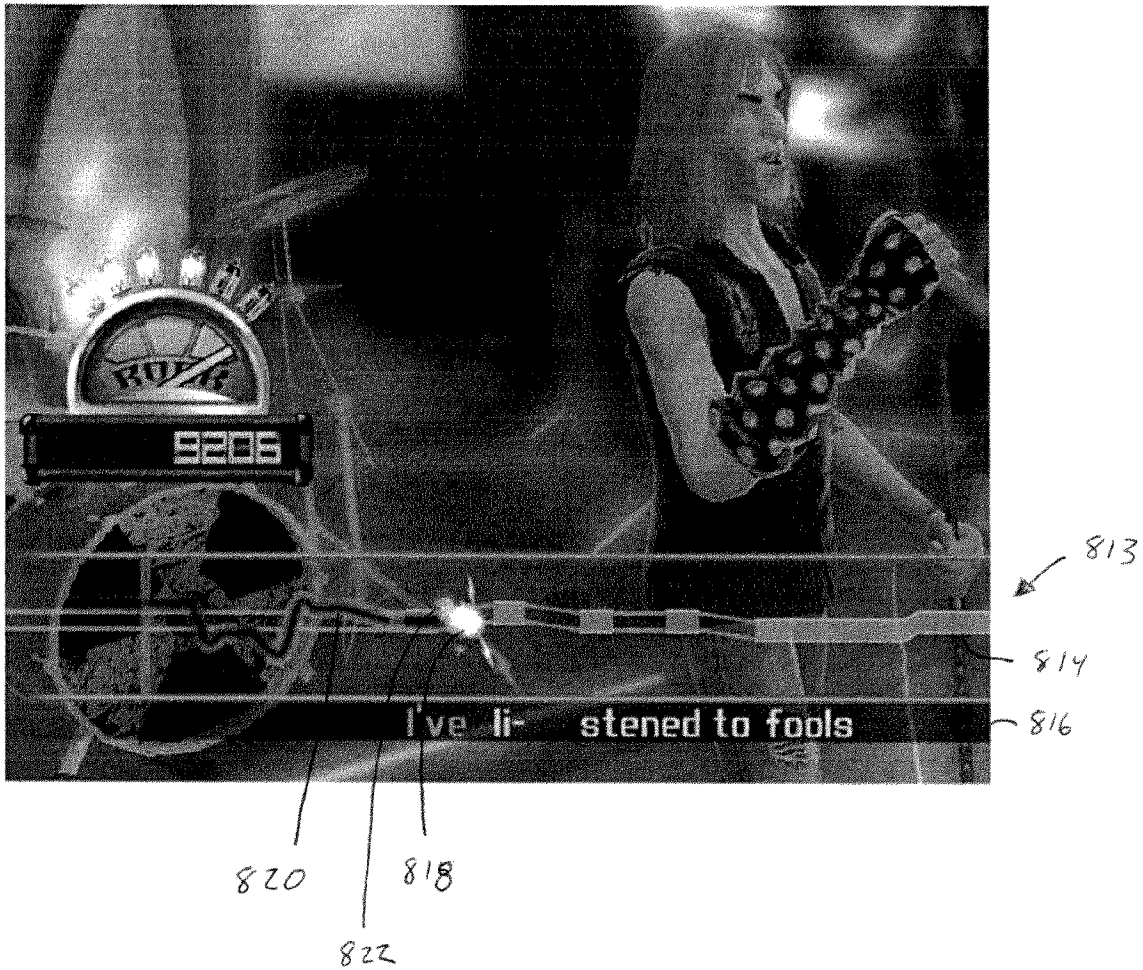
FIG. 8 is a screen shot of a video game in accordance with aspects of the invention.

Turning first to the lyrics mode, in block 704 the process presents lyrics and an indication of the desired pitch at which the lyrics are to be sung. In one embodiment, as shown in the screen shot of FIG. 8, a vocal highway 813 may be presented which includes a commanded pitch indicator 814 and a lyrics ribbon indicator 816 disposed within the vocal highway. The commanded pitch indicator indicates a pitch at which a game player is to sing, and in some embodiments, the commanded pitch indicator may indicate a steady pitch and a duration, or continuing pitch changes over time, for example. The continuing pitch changes, for example, may be represented by the commanded pitch indicator by an upwardly sloped section or a downwardly sloped section. The pitch at which the game player is to sing, which generally changes over the course of a song, may be determined through analysis or examination of data for the song, for example MIDI data or other data, or may be determined or selected by other methods. In block 706, the process determines a pitch of received input signals, for example in some embodiments input signals provided by a microphone. In various embodiments the process may determine the pitch using, for example, an Average Magnitude Difference Function (AMDF), a Harmonic Product Spectrum (HPS) method, or a Log Harmonic Product Spectrum method. Some embodiments utilize a method described in the previously mentioned McLeod, P. and Wyvill, G. "A Smarter Way to Find Pitch" In Proceedings of International Computer Music Conference (ICMC) 2005, Barcelona, Spain, (2005) 138-141.

In block 708, the process compares the pitch of the received input signals to the commanded pitch. In one embodiment, as the player performs, a game play interface, such as the display of FIG. 8, may provide a visual queue to the player as to the player's accuracy with regard to pitch.

In block 710, the process determines a score for the game player based on the comparison of the commanded pitch and the pitch of the received input signals. In some embodiments, the score for the game player is increased if the pitch of the received input signals is within a semitone or some other preidentified range of the commanded pitch. In some embodiments the score is based on a comparison over a frame or a lyrical phrase. In one embodiment, each lyrical phrase is divided into frames (for example with 30 frames per second) and the game player is rated with each passing frame. For example, if the game player sings, as indicted by the received input signals, within the preidentified range of the commanded pitch for a frame, the process mark the frame as a "hit". At the completion of a lyrical phrase, the process may determine a percentage of frames "hit" and increase the score of the game player by the percentage of a point value allocated for the lyrical phrase, as well as providing a rating of "BAD", "Weak", "OK, "Good", or "EXCELLENT" for the game player in some embodiments.

In addition, the process may command display of display elements indicating status of game play, for example results of the comparison of commanded pitch and pitch of the received input signals and the scoring. In one embodiment, a pitch indicator in the form of a cornet may be provided, with a head of the comet indicating pitch of currently received input signals and a trailing tail indicating pitch of previously received input signals over time. In addition, the comet may have particles emitted from the head during game play, with the color and the number of emitted particles indicating extent of the game player's performance in providing input signals with the proper pitch. For example, referring again to FIG. 8, a cornet 818 may have a continuous historical tubular wire frame trailing tail 820 as it or the background frame moves or changes. As the game player sings into a microphone, the process compares pitch of input signals provided by the microphone with commanded pitch and a trailing tail 822 emitted by the comet changes color and height, to indicate that the process registered a certain pitch, for example for a certain duration.

In block 712 the process determines whether the process should exit, for example if the video game is over or has otherwise ended. If so, the process returns, otherwise the process goes to block 702.

Referring again to block 702, if the process is in free-form mode, the process performs free-form vocal mode video game processing. In many embodiments, during free-form vocal mode video game processing a game player is not presented lyrics to sing, with the lyrics to be sung at particular preidentified pitches at different points in time. Instead, in many embodiments, in free-form vocals mode the game player is to sing in a manner expected to be aurally aesthetically pleasing in the context of a musical piece or a portion of a musical piece, without presentation of lyrics or commanded pitch for predetermined times. For example, the game player may sing lyrics originally associated with a musical composition or song, or the game player may sing "made-up," "ad-libbed" or other lyrics different than the lyrics originally associated with the musical composition or song.

In some embodiments the process may command presentation of display elements on a display to indicate to the game player that the game player should sing in a manner consistent with the free-form vocals mode. In one embodiment, during free-form mode a game player may be presented with a display as shown in the display of FIG. 1, for example with the display including overlapping waves separated by vertical divider, and, as shown in FIG. 1, a comet head indicating a current pitch of received input signals.

If in free-form vocals mode the process continues to block 703. In block 703, the process determines a pitch of received input signals. For example, in some embodiments a game player's free-form vocal utterances may be converted to an electrical signal by a microphone while the game player is presented audio portions of a prerecorded musical composition. The microphone provides input signals to, for example, a video game console performing the process. The video game console may determine, for example as previously discussed, a pitch of the input signals.

In block 705, the process compares the pitch of the received input signals with a target key. In some embodiments the process considers the pitch of the received input signals to match the target key if the pitch of the received input signals is within a certain number of semitones, for example 3 semitones, of the target key. In some embodiments the target key is selected by a developer of the video game, and preferably the target key is related to a key of a musical composition. In some embodiments the target key is the key of the musical composition, which may be a song or portions of a song, the audio of which is presented to the game player. In some embodiments the key of the song or portion of the song is the song's harmonic center or tonic.

In block 707, the process compares a history of pitch of received input signals and a beat of the musical composition. The tempo of a musical composition may be indicated in beats per minute (BPM), and the process in block 707 may determine if changes in pitch occur with the same frequency of the tempo of the musical composition presented to the game player, or at times consistent with the tempo of the musical composition presented to the game player.

In block 709, the process determines a score for the game player. The score may be based on a percentage of time that the pitch of the received input signals match the preidentified key and the number of times pitch changes occur in time with beats of the musical composition. In some embodiments the process commands display of the score on a display, or stores the score in memory.

The process then continues to block 712, and either exits or returns to block 702.

Figure 9:
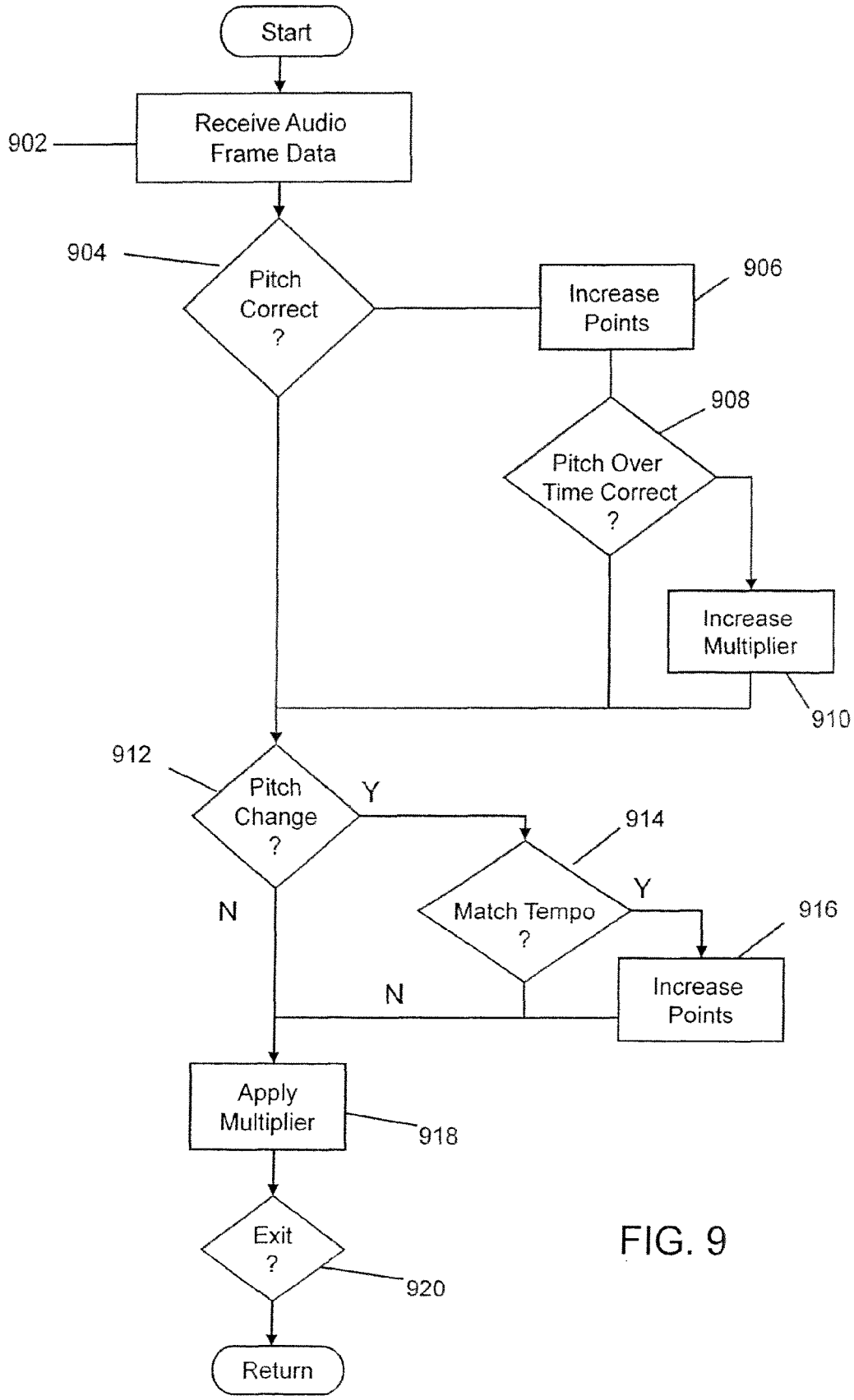
FIG. 9 is a flow diagram of a process of determining a video game scoring in accordance with aspects of the invention.

FIG. 9 is a flow diagram of a process for performing video game scoring in accordance with embodiments of the present invention. In the process of FIG. 10, the process quantifies how accurately a game player is in compliance with a tempo and a key for a musical piece or sections of a musical piece. The more accurately the game player sings in a free-form in tempo and in key with the song, the more points are awarded to the player. The process may be performed, for example, by a video game console or a processor.

In block 902, the processor receives audio frame data. The audio frame data is audio information for a frame. The frame may be, for example, 1/30 of a second. The audio information may be a digital representation of information provided by a microphone.

In block 904, the process determines if pitch of the audio frame data matches a target key, for example relating to a key of a song, the audio of which is provided or partially provided to the game player. The process may determine the pitch of the audio frame data as previously discussed. If the pitch of the audio frame data does not match the target key the process continues to block 912. If the pitch of the audio frame data matches the target key, the process increases a player's point total in block 906, and determines if the pitch of the audio frame data has matched the preidentified key over time, for example several audio frames, in block 908. If the audio frame data matches the preidentified key over time, the process increases a score multiplier in block 910, and the process may also command display of an indication of the score multiplier on the display, for later application to the score, and the process continues to block 912.

In block 912, the process determines if the audio frame data reflects a change in pitch. If yes, in block 914 the process determines if the change in pitch is synchronous or substantially synchronous or consistently asynchronous as determined by the video game programmer with a beat of the song. If so, in block 916, the player's point total is increased, otherwise the process continues to block 918. In block 918, the multiplier is applied for further increases in points.

In block 920, the process determines whether to exit. If so, the process returns, otherwise the process goes to block 902.

The invention therefore provides for a free-form vocals mode in a music related video game, and for scoring of a free-form vocals mode in a music related video game. Although the invention has been described with respect to certain embodiments, it should be recognized that the invention may be practiced other than as specifically described, the invention comprising the novel and unobvious claims and their insubstantial variations supported by this disclosure.

What is claimed is:

1. A method for evaluating vocal inputs of a game player in a music based video game, comprising:

receiving input signals providing audio information;

determining, for a particular time, a pitch of the audio information;

comparing the pitch to a plurality of predetermined target pitches for the particular time, at least some pitches of the plurality of predetermined target pitches separated from other pitches of the plurality of predetermined target pitches by pitches not included in the plurality of predetermined target pitches;

determining a valuation based on the comparison of the pitch to the plurality of target pitches; and commanding presentation of an indication of the valuation.

2. The method of claim 1 wherein the predetermined target pitches are associated with a key of a musical piece.

3. The method of claim 1 wherein the predetermined target pitches are associated with a key of a portion of a musical piece.

4. The method of claim 1 wherein the separate target pitches are associated with a key of a musical instrument during a portion of a musical piece.

5. The method of claim 1 wherein the predetermined target pitches each comprise a range of pitches.

6. The method of claim 2 further comprising presenting portions of the musical piece to a game player.

7. The method of claim 6 wherein presenting portions of the musical piece to the game player comprises presenting audio portions of the musical piece to the game player.

8. The method of claim 1 further comprising: receiving further input signals providing further audio information; determining a further pitch of the further audio information; determining if the further pitch indicates a change in pitch; determining if timing of the change in pitch is in accordance with a target tempo; and modifying the valuation based on whether timing of the change in pitch is in accordance with the target tempo.

9. The method of claim 8 wherein determining if timing of the change in pitch is in accordance with a target tempo comprises determining if timing of the change in pitch is substantially in time with a target beat of the target tempo.

10. The method of claim 9 further comprising commanding display of an indication of the target beat.

11. The method of claim 1 further comprising commanding display of a point score reflecting the valuation.

12. The method of claim 1 wherein at least some of the plurality of predetermined target pitches comprise pitches separated by one or more octaves.

13. The method of claim 1 wherein at least some of the plurality of predetermined target pitches comprise pitches of a scale.

14. The method of claim 1 wherein determining a point increase based on the comparison of the pitch to the plurality of separate target pitches comprises determining a point increase if the pitch is within a predefined range of any of the predetermined target pitches.

15. The method of claim 14 further comprising receiving a selection of a skill level of a plurality of skill levels, and wherein the predefined range is different for at least some of the plurality of skill levels.

16. A method for providing a video game, comprising:

commanding display of a commanded pitch and lyrics;

commanding audio presentation of at least a portion of a musical piece;

receiving an input signal including audio information; determining a pitch of the audio information;

determining if the pitch matches the commanded pitch;

increasing a point score if the pitch matches the commanded pitch;

commanding display of an indication that a game player should perform free-form vocals;

receiving over time further input signals including further audio information;

determining over time pitch of the further audio information;

comparing the pitch of the further audio information to notes associated with a key of the musical piece;

comparing changes in pitch over time of the further audio information to a tempo of the musical piece;

further increasing the point total if the pitch of the further audio information matches the notes associated with the key of the musical piece; and further increasing the point total if the changes in pitch over time of the further audio information matches the tempo of the musical piece.

17. The method of claim 16 further comprising commanding display of the point total.

18. The method of claim 16 wherein the pitch of the further audio information matches the key of the song if the pitch of the further audio information is within a predetermined number of semitones of the key of the musical piece.

* * * * *